US005188352A

United States Patent [19]

Bartman et al.

[11] Patent Number: 5,188,352

[45] Date of Patent: Feb. 23, 1993

[54] COPY OUTPUT STACKER FOR ENGINEERING SIZE COPIES

[75] Inventors: David A. Bartman; Daniel L. Morris, both of Webster; Albert E. Andrews, Rochester, all of N.Y.

[73] Assignee: Xerox Corporation, Stamford, Conn.

[21] Appl. No.: 861,669

[22] Filed: Apr. 1, 1992

[51] Int. Cl.[5] ..... B65H 29/54

[52] U.S. Cl. ..... 271/175; 271/207

[58] Field of Search ..... 271/65, 145, 171, 175, 271/207, 209

[56] References Cited

U.S. PATENT DOCUMENTS

| | | | |
|---|---|---|---|
| 3,704,884 | 12/1972 | Nicolay et al. | 271/175 |
| 4,768,063 | 8/1988 | Kunishima et al. | 271/207 X |
| 4,961,091 | 10/1990 | Kasuya et al. | 271/207 X |
| 5,040,777 | 8/1991 | Bell et al. | 271/3 |

FOREIGN PATENT DOCUMENTS

| | | | |
|---|---|---|---|
| 0067455 | 4/1982 | Japan | 271/145 |
| 0031465 | 2/1985 | Japan | 271/209 |
| 0197269 | 8/1989 | Japan | 271/209 |
| 0166157 | 7/1991 | Japan | 271/207 |

*Primary Examiner*—H. Grant Skaggs
*Assistant Examiner*—Carol Lynn Druzbick

[57] ABSTRACT

A copy output stacker for a wide format copier/printer holds and stacks a wide range of copy sizes exiting a copier/printer. The copies are stacked conveniently in front of the copier/printer without occupying much space. The stacker includes the use of an inverted "window shade" assembly with its roller spring mechanism attached on one end of the base of the roll feed/cutter assembly of the copier/printer, while the other end is pulled out and attached at an angle in front of the media supply drawer in order to form a pocket to catch copy sheets exiting the copier/printer.

5 Claims, 3 Drawing Sheets

COPY OUTPUT STACKER FOR ENGINEERING SIZE COPIES

This invention relates to a copier/printer machine that prints page image information onto copy sheets composed of a variety of media, including bond, vellum, film and tracing paper or the like, measuring 18, 24, 36, 48×36", and more particularly, to an improved copy output stacking device for such a machine.

Heretofore, some copy output stackers on wide format copier/printers that are used to copy engineering drawings have included a stacking device that has a tray with a fixed depth. This type of stacking device made staking multiple length copy sheets impractical. Other copy sheet stacking devices require an operator to make multiple manual adjustments to adjust the size of the stacking device according to the size of original documents being fed into the machine. In order to make the operator more efficient and the copying process less labor intensive, a need exists for an improved copy output stacking device.

It is therefore an object of this invention to provide a copy sheet stacking device for stacking a variety of wide and long copy sheets without operator involvement.

Therefore, the present invention provides a copy output device that comprises an inverted "window shade" web assembly that has its roller/spring mechanism attached to the machine housing base. The "shade" or web portion of the assembly is then pulled out and attached at a slight angle in front of the machine to a selected pair of a plurality of stationary web support brackets. The length of the media to be run determines which pair of web support brackets to which the web is positioned.

Figure 1:
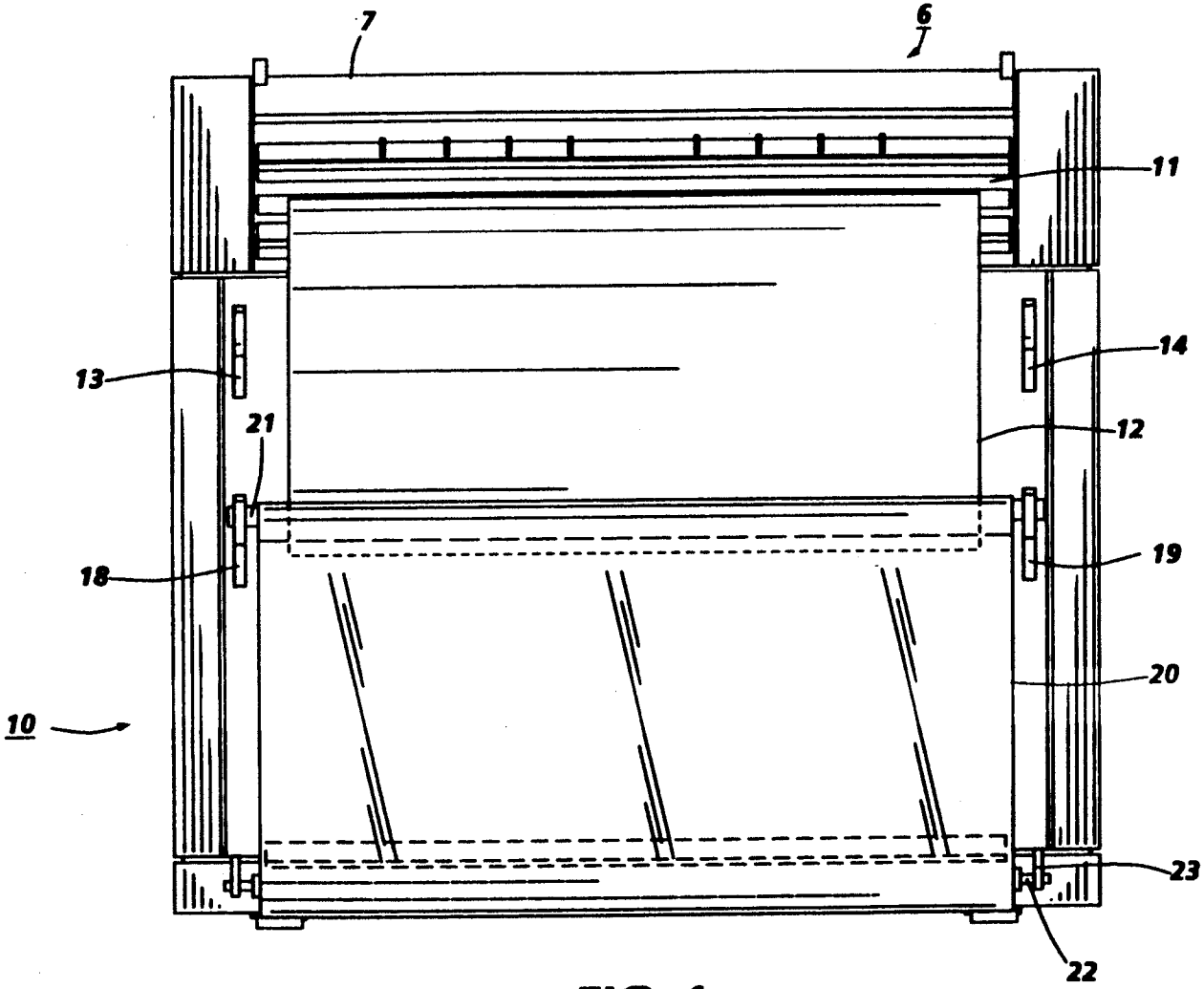
FIG. 1 is a schematic front view of the copy output stacker of the present invention mounted on a conventional copier/printer.

Referring now to the drawings in detail, and wherein like numbers indicate like elements, copy output stacking device 10 is shown attached to a copier/printer 6, such as shown, for example, in U.S. Pat. No. 5,404,777 which is incorporated herein by reference. The copier/-printer 6 includes a housing 7 that incorporates the machine's xerographic section and a copy sheet supply section 8. Copy output stacking device 10 is positioned outside the front of the copy sheet supply section and is adapted to allow access to the machines copy sheet supply whether roll feed or cut sheet is employed.

Copy sheet output device 10 is adapted to gather the output copies from a machine as they exit the front of the machine and stack them in the same order as the sequence of originals or as the images are presented by a printer. The copies within the stack can be random in size, ranging from "A" to "E" size, and be composed of any media desired. The stacker creates little or no obstruction to access to the media supply in a roll feed and cutter assembly (not shown) which is positioned in the bottom of the machine. As shown in FIG. 1, the front of machine housing 8 has a plurality of brackets 13, 14, 18, and 19 attached thereto in pairs at predetermined heights. Each bracket has a relieved area therein for use that will be described hereinafter. An inverted "window shade" or web 20 is unrolled to the point of brackets 18 and 19 and has a web support bar 21 positioned within the relieved area of the brackets. The web is wound upon a roller 22 which is supported by brackets 23 connected to housing 8 and forms a stacking device for copy sheets 12 exiting portion 11 of housing 7. Roller assembly 26 includes web 20, web support member 21, roller 22 and a spring (not shown) which keeps the web in tension so that when web support member 21 is removed from brackets 18 and 19, the web will have a pull towards roller 22. An angled iron 24 forms a base copy sheet support for the copy sheets exiting the machine. The relieved areas in brackets 13, 14, 18 and 91 are located such that the resting of web support shaft 21 therein will cause the web to take an inverted triangular appearance, i.e., the web is angled slightly away from the front of the machine with the apex of the triangle being toward the bottom of housing 7. The length of the copy sheets desired determines which pair of brackets will support web 20.

Figure 2:
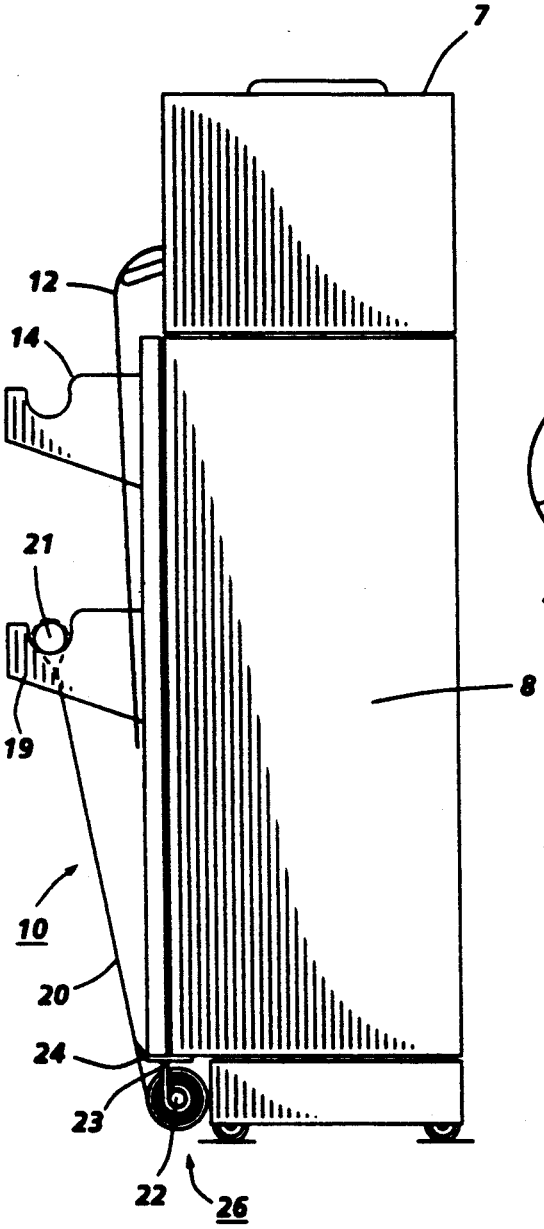
FIG. 2 is a schematic side view of the copy output stacker of FIG. 1 showing a copy sheet exiting the copier/printer.
Figure 3:
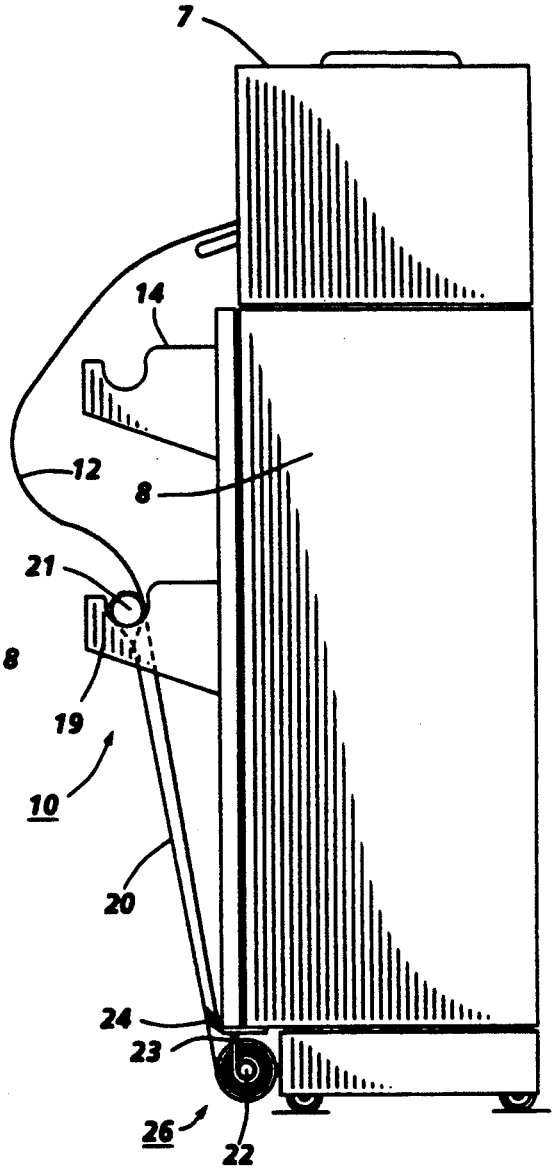
FIG. 3 is a schematic side view of the copy output stacker of FIG. 1 showing a copy sheet exiting the copier/printer with a lead edge thereof resting in the output stacker.
Figure 4:
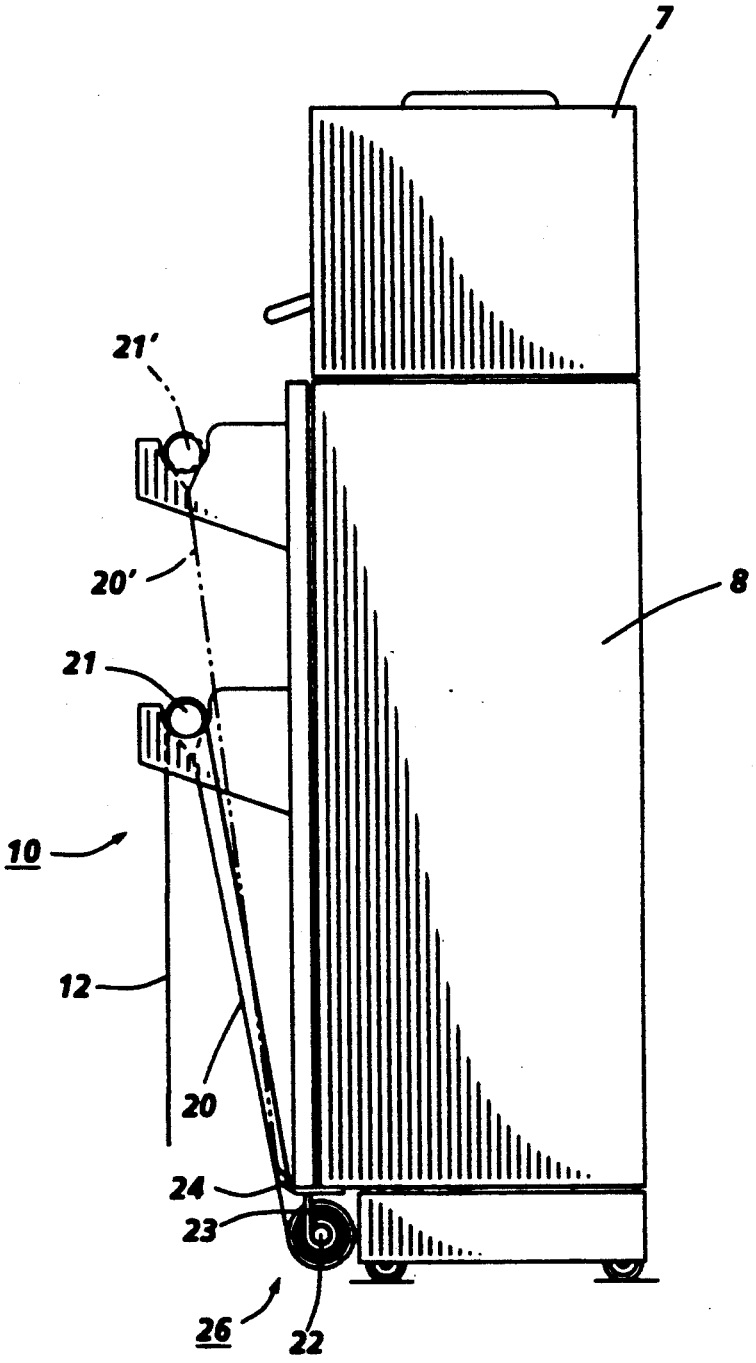
FIG. 4 is a schematic side view of the copy output stacker of FIG. 1 showing a copy sheet that has exited the copier/printer with a trail end thereof hanging outside the output stacker.

With reference to FIG. 2, when a copy of a document or page image information is to be made and as the output copy sheet 12 is fed out of the machine, the lead edge of the copy sheet 12 is driven downward by gravity and proceeds on a path bounded by the front face of the copy sheet storage area of the machine and the extended web. The lead edge proceeds downward until it reaches copy sheet support member 24 which forms a base for the stacking device. When this occurs, the lead edge stops, the trail edge continues to feed out of the machine as shown in FIGS. 3 and 4, forcing the body of the copy sheet over web support bar 21. As the copy sheet clears the machine, it flips over web support 21 and hangs, image down, over the support bar. The height of the web support bar is set prior to the copy run according to the length of the copies expected during the run. The bar is set to a height such that more than half of the length of a copy sheet will be contained between the web and the front of the media storage portion of the machine. This allows the newly completed copy sheet stack to drape over the web support bar without falling out of the stacking device as shown in FIG. 4. Generally, only two settings of web 20 are required, one for 36" to 48" copies as shown in solid lines in FIGS. 1–4, and another for less than 36" copies as shown in dotted lines in FIG. 4.

Several advantages are obtained with use of the copy output stacker 10 including: low cost when compared with copy output stackers made from sheet metal, wire forms or plastic; and the unique ability to simply wind-up out of the way for easy access to the media supply. Also, if media needs to be added during a job with copies already in the stacker, releasing the web support bar would cause the copies to roll up along with the web. It should be understood that the roller assembly 26 can be made easily detachable at the end of a job run and the web support 21 could be released to wind the copy stack around the roller, and the roller assembly would then be detached to carry the copy stack back to a workplace.

This invention has been described in detail with particular reference to a preferred embodiment thereof, but it will be understood that variations and modifications can be effected within the spirit and scope of the invention and all such variations and all such variations and modifications are intended to be covered by the appended claims.

What is claimed is:

1. A copy output stacker for a wide format machine, comprising:

an upstanding front portion of the machine;

at least one pair of orthogonally extending support brackets connected to said upstanding front portion of the machine and positioned at a predetermined height with respect to the base of the machine; and a roller assembly connected to the machine at a predetermined position below said at least one pair of support brackets, said roller assembly including web and a spring tensioned roller support member for supporting said web in a scrolled up position wound around said roller support member, and wherein said web includes a web support bar that is positionable with respect to said at least one pair of support brackets such that said web is extended at an angle with respect to the front of the machine in order to create a pocket to catch copies exiting the machine.

2. The copy output stacker of claim 1, including means immediately above said roller assembly for supporting the lead edges of copies exiting the machine.

3. The copy output stacker of claim 2, wherein each of said at least one pair of support brackets include a relieved area wherein said web support bar rests when said web is in an extended position.

4. The copy output stacker of claim 2, wherein means immediately above said roller assembly for supporting the lead edges of copies exiting the machine is an angle iron.

5. The copy output stacker of claim 1, wherein said roller assembly is detachably mounted with respect to the machine.

* * * * *